US008376696B2

(12) United States Patent
Suzuki et al.

(10) Patent No.: US 8,376,696 B2
(45) Date of Patent: Feb. 19, 2013

(54) VARIABLE-CAPACITY EXHAUST TURBOCHARGER EQUIPPED WITH VARIABLE-NOZZLE MECHANISM

(75) Inventors: Hiroshi Suzuki, Sagamihara (JP); Yasuaki Jinnai, Sagamihara (JP); Yoichi Ueno, Sagamihara (JP); Noriyuki Hayashi, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 790 days.

(21) Appl. No.: 12/597,138

(22) PCT Filed: Oct. 3, 2008

(86) PCT No.: PCT/JP2008/068403

§ 371 (c)(1),
(2), (4) Date: Oct. 22, 2009

(87) PCT Pub. No.: WO2009/081642

PCT Pub. Date: Jul. 2, 2009

(65) Prior Publication Data

US 2010/0124489 A1 May 20, 2010

(30) Foreign Application Priority Data

Dec. 21, 2007 (JP) ..... 2007-331119

(51) Int. Cl.
*F01D 17/16* (2006.01)

(52) U.S. Cl. ..... 415/164; 415/165

(58) Field of Classification Search ..... 415/164, 415/165

See application file for complete search history.

(56) References Cited

U.S. PATENT DOCUMENTS

| | | | | |
|---|---|---|---|---|
| 4,657,476 | A * | 4/1987 | Berg | 415/48 |
| 4,684,319 | A * | 8/1987 | Sasaki | 415/164 |
| 6,669,442 | B2 * | 12/2003 | Jinnai et al. | 415/160 |
| 7,114,919 | B2 * | 10/2006 | Scholz et al. | 415/164 |
| 7,406,826 | B2 | 8/2008 | Hayashi et al. | |
| 2002/0168262 | A1 | 11/2002 | Jinnai | |
| 2006/0179838 | A1 | 8/2006 | Nakagawa et al. | |

FOREIGN PATENT DOCUMENTS

| | | | |
|---|---|---|---|
| JP | 3-35203 | U | 4/1991 |
| JP | 2001-329851 | A | 11/2001 |
| JP | 2006-220092 | A | 8/2006 |
| JP | 2007-56791 | A | 3/2007 |

* cited by examiner

*Primary Examiner* — Ninh H Nguyen
(74) *Attorney, Agent, or Firm* — Birch, Stewart, Kolasch & Birch, LLP

(57) ABSTRACT

A variable-capacity exhaust turbocharger is provided which is equipped with a variable-nozzle mechanism having a lever plate and a peripheral structure capable of ensuring regular operability of a nozzle vane and of preventing an occurrence of local excessive stress by increasing rigidity of the lever plate without increasing a thickness of the lever plate. In a variable-capacity exhaust turbocharger equipped with a variable-nozzle mechanism including: a plurality of nozzle vanes; an annular drive ring; and a lever plate provided as many as the number of the nozzle vanes so that one end is connected to an engagement pin portion engaging with a groove portion formed in the drive ring and the other end is fixed to each nozzle vane, the drive ring is disposed between the lever plate and a nozzle mount in an axial direction, and the lever plate is curved in an axial direction from a surface of the lever plate connected to the fixed portion on the side of the nozzle vane so as to be connected to the groove portion of the drive ring.

12 Claims, 7 Drawing Sheets

VARIABLE-CAPACITY EXHAUST TURBOCHARGER EQUIPPED WITH VARIABLE-NOZZLE MECHANISM

BACKGROUND OF THE INVENTION

1. Field of the Invention

The present invention relates to a variable-capacity exhaust turbocharger equipped with a variable-nozzle mechanism which is used for an exhaust turbocharger of an internal-combustion engine and includes a plurality of nozzle vanes rotatably supported to a nozzle mount, a rotational-driven annular drive ring, and a lever plate of which one end engages with the drive ring and another end is fixed to each nozzle vane, where each blade angle of the plurality of nozzle vanes is changed in such a manner that the lever plate is swung by a rotation of the drive ring.

2. Description of the Related Art

Among comparatively small-size exhaust turbochargers used for a vehicle internal-combustion engine or the like, a double-flow-type variable-capacity exhaust turbocharger equipped with a variable-nozzle mechanism is widely used in which exhaust gas discharged from an engine is filled into a scroll formed in a turbine casing to act on a turbine rotor formed on the inner-peripheral side of each nozzle vane via a plurality of nozzle vanes formed on the inner-peripheral side of the scroll and each blade angle of the plurality of nozzle vanes is capable of being changed.

FIG. 7 is a partially sectional view showing an example of the exhaust turbocharger equipped with the variable-nozzle mechanism according to a conventional art when taken along the rotary axis line. FIG. 8 is a sectional view taken along the line D-D shown in FIG. 7. FIG. 9 is a sectional view taken along the line C-C shown in FIG. 8.

In FIGS. 7 to 9, Reference Numeral 10 denotes a turbine casing and Reference Numeral 11 denotes a scroll having a spiral shape formed in the outer periphery of the turbine casing 10.

Reference Numeral 12 denotes a double-flow-type turbine rotor coaxially formed with a compressor (not shown), and a turbine shaft 12*a* thereof is rotatably supported to a bearing housing 13 via a bearing 16. Reference Numeral 100*a* denotes a rotary axis line of the exhaust turbocharger.

Reference Numeral 2 denotes a plurality of nozzle vanes arranged in the inner periphery of the scroll 11 in a circumferential direction at the same interval therebetween, and a nozzle shaft 02 connected to each end portion thereof is rotatably supported to a nozzle mount 4 fixed to the turbine casing 10, thereby changing a blade angle by the use of a variable-nozzle mechanism 100.

In the variable-nozzle mechanism 100, the nozzle vane 2 is disposed between the nozzle mount 4 and an annular nozzle plate 6 coupled to the nozzle mount 4 via a plurality of nozzle support members 5*a*. The nozzle plate 6 is fitted to an attachment portion of the turbine casing 10.

Reference Numeral 3 denotes a drive ring formed in a disk shape and rotatably supported to the nozzle mount 4, and drive pins 22 are fixed in a circumferential direction at the same interval therebetween.

Reference Numeral 1 denotes a lever plate, where an input-side groove thereof engages with each drive pin 22 and an output side thereof is fixed to the nozzle shaft 02.

Reference Numeral 15 denotes a linkage connected to an actuator (not shown) as a driving source of the nozzle vane 2, and Reference Numeral 10*s* denotes a crank pin connected to the linkage 15. The crank pin 14 engages with the drive ring 3 so as to rotationally drive the drive ring 3.

Upon operating the variable-capacity exhaust turbocharger equipped with the variable-nozzle mechanism with the above-described configuration, exhaust gas discharged from an engine (not shown) flows into the scroll 11, and flows into the nozzle vane 2 while orbiting along the spiral of the scroll 11. Subsequently, the exhaust gas flows between the blades of the nozzle vane 2 and flows into the turbine rotor 12 from the outer-peripheral side. Subsequently, the exhaust gas flows toward the center in a radial direction to perform an expanding action to the turbine rotor 12 and flows in an axial direction to be guided to a gas outlet 10*b*, thereby being discharged to the outside.

Upon controlling the capacity of the variable-capacity turbine, in the actuator, a blade angle of the nozzle vane 2 is set by a blade angle control unit (not shown) so that a flow rate of the exhaust gas flowing to the nozzle vane 2 is equal to a required flow rate. A reciprocating displacement of the actuator corresponding to the blade angle is transmitted to the drive ring 3 via the linkage 15 and the crank pin 10*s* so as to rotationally drive the drive ring 3.

In terms of the rotation of the drive ring 3, the lever plate 1 is rotated in a circumferential direction of the nozzle shaft 02 by the drive pins 22 fixed to the drive ring 3 in a circumferential direction at the same interval therebetween. Subsequently, in terms of the rotation of the nozzle shaft 02, the nozzle vane 2 is rotated, and the blade angle thereof is changed to the blade angle set in the actuator.

Another example of the double-flow-type variable-capacity exhaust turbocharger equipped with the variable-nozzle mechanism is disclosed in Patent Document 1 (Japanese Patent Application Laid-Open No. 2007-56791).

However, the exhaust turbocharger equipped with the variable-nozzle mechanism according to the conventional art shown in FIGS. 7 to 9 still has the following problems to be solved.

That is, in the variable-nozzle mechanism shown in FIGS. 7 to 9, as shown in FIG. 9, the drive ring 3 is disposed between the lever plate 1 and the nozzle mount 4 in an axial direction, and the drive pin 22 fixed to the drive ring 3 is fitted to the groove is of the lever plate 1 so as to drive the lever plate 1 via the drive ring 3 and the drive pin 22.

For this reason, since the drive pin 22 contacts with the lever plate 1 so as to drive the lever plate 1 via the drive ring 3 and the drive pin 22 on the same plane as the lever plate 1 directly connected to the nozzle vane 2, bending moment occurs at the contact portion between the drive pin 22 and the lever plate 1.

Accordingly, the nozzle shaft 02 supporting the nozzle vane 2 is inclined with respect to a hole formed in the nozzle mount 4, thereby causing local excessive stress. As a result, the nozzle vane 2 cannot be operated regularly, and a portion between the nozzle vane 2 and the lever plate 1 is broken.

FIGS. 10 and 11 show the variable-nozzle mechanism disclosed in Patent Document 1, where FIG. 10 is a front view showing the variable-nozzle mechanism, and FIG. 11 is a sectional view taken along the line E-E shown in FIG. 10.

In this example, the drive pin 22 is fixed to the lever plate 1, and the drive pin 22 is fitted to a groove 3*a* of the drive ring 3. In this case, since a contact point between the groove 3*a* of the drive ring 3 and the drive pin 22 is located on the driving-side drive ring 3, the amount of the above-described bending moment is little, thereby hardly causing the above-described problem.

However, in Patent Document 1, it is necessary to reduce a deformation applied from the drive ring 3 to the nozzle shaft 02 by increasing a thickness of the lever plate 1 in consideration of the bending moment at the contact portion between the lever plate 1 and the drive pin 22. For this reason, since the thickness of the lever plate 1 increases, the regular operation of the nozzle vane 2 is disturbed, and a decrease in weight and size in operation is disturbed.

SUMMARY OF THE INVENTION

The present invention is contrived in consideration of the above-described problems, and an object of the invention is to provide a variable-capacity exhaust turbocharger equipped with a variable-nozzle mechanism having a lever plate and a peripheral structure capable of ensuring regular operability of a nozzle vane and of preventing an occurrence of local excessive stress by increasing rigidity of the lever plate without increasing a thickness of the lever plate.

In order to obtain the above-described object, according to an aspect of the invention, there is provided a variable-capacity exhaust turbocharger equipped with a variable-nozzle mechanism including: a plurality of nozzle vanes rotatably supported to a nozzle mount fixed to a bearing housing or a casing including a turbine casing; an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate is curved in an axial direction from a surface of the lever plate connected to the fixed portion on the side of the nozzle vane so as to be connected to the groove portion of the drive ring.

The lever plate may have the following configuration.

(1) The engagement pin portion of the lever plate is formed into an engagement protrusion integrally formed with the lever plate and engaging with the groove portion.

(2) The engagement pin portion of the lever plate is formed in such a manner that an engagement pin is fitted in a direction perpendicular to a surface of the lever plate and the engagement pin engages with the groove portion.

According to another aspect of the invention, there is provided a variable-capacity exhaust turbocharger equipped with a variable-nozzle mechanism including: a plurality of nozzle vanes rotatably supported to a nozzle mount fixed to a bearing housing or a casing including a turbine casing; an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein a curved portion curved in an axial direction from a surface of the lever plate connected to the fixed portion on the side of the nozzle vane and an engagement protrusion connected to the curved portion and engaging with the groove portion are formed by bending one sheet of plate.

In the variable-capacity exhaust turbocharger equipped with the variable-nozzle mechanism with the above-described configuration, the engagement pin portion of the lever plate may be formed in an oval shape in which a section of a fitting-sliding surface of the engagement pin portion is formed in a circular-arc shape and a non-sliding portion of the engagement pin portion is formed in a linear shape; and a long axis of the oval shape may be disposed in a circumferential direction of the drive ring.

According to still another aspect of the invention, there is provided a variable-capacity exhaust turbocharger equipped with a variable-nozzle mechanism including: a plurality of nozzle vanes of which both ends are supported so that one end is rotatably supported to a nozzle mount fixed to a bearing housing or a casing including a turbine casing and the other end is supported to a nozzle plate; an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate has the above-described configuration.

According to the invention, the drive ring is disposed between the lever plate and the nozzle mount in an axial direction, and the lever plate is curved in an axial direction from a surface of the lever plate connected to the fixed portion on the side of the nozzle vane so as to be connected to the groove portion of the drive ring. A portion of the lever plate between the fixed portion on the side of the nozzle vane and the engagement pin portion in the drive ring is curved in an axial direction from the surface of the lever plate. Accordingly, a ring thickness between the fixed portion on the side of the nozzle vane and the engagement protrusion in the drive ring is thickened as much as the curved amount in an axial direction, thereby increasing rigidity in an axial direction and bending rigidity. Meanwhile, since the lever plate is configured as a plate member curved in an axial direction, a weight of the lever plate itself does not increase. Accordingly, it is possible to increase the bending rigidity without increasing the thickness of the lever plate.

Additionally, since the curved portion, that is, an offset portion is formed in the lever plate in an axial direction, it is possible to easily form the engagement pin portion (boss portion) having a required thickness in the lever plate configured as the thin plate.

Since the engagement portion between the engagement pin portion and the groove portion is provided close to the upper portion of the drive ring, bending moment at the engagement portion is reduced, thereby restricting a risk occurring when a linkage system is broken.

Since the engagement pin portion of the lever plate is configured in such a manner that an engagement pin is fitted in a direction perpendicular to a surface of the lever plate and the engagement pin engages with the groove portion, only the engagement pin is formed of material having high rigidity against vibration, and the lever plate is configured as a low-cost member, thereby reducing a cost.

Since the curved portion curved in an axial direction from the surface of the lever plate connected to the fixed portion on the side of the nozzle vane and the engagement protrusion connected to the curved portion and engaging with the groove portion are formed by bending one sheet of plate, it is possible to form the engagement protrusion for allowing the lever plate to engage with the groove portion of the drive ring. Accordingly, it is possible to manufacture the lever plate at a low cost and to restrict the outer diameter of the lever plate.

Since the engagement pin portion of the lever plate is formed in an oval shape in which the section of the fitting-sliding surface of the engagement pin portion is formed in a circular-arc shape and the non-sliding portion of the engagement pin portion is formed in a linear shape, and a long axis of the oval shape is disposed in a circumferential direction of the drive ring, the outer periphery of the engagement pin portion formed in the oval shape is connected. Accordingly, the rigidity of the engagement pin portion is more improved than that of a U-shape engagement pin portion, and an outer diameter thereof is reduced as small as possible.

The lever plate structure having the above-described configuration may be applied to the supercharger equipped with the plurality of nozzle vanes of which both ends are supported in such a manner that one end is rotatably supported to the nozzle mount and the other end is supported to the nozzle plate.

DESCRIPTION OF THE PREFERRED EMBODIMENTS

Hereinafter, exemplary embodiments of the invention will be described in detail with reference to the accompanying drawings. Here, although the dimension, the material, the shape, the relative arrangement, and the like of the component are described in the embodiment, the scope of the invention is not limited thereto so long as a particular description is not made, but those are only examples for a description.

Figure 1:
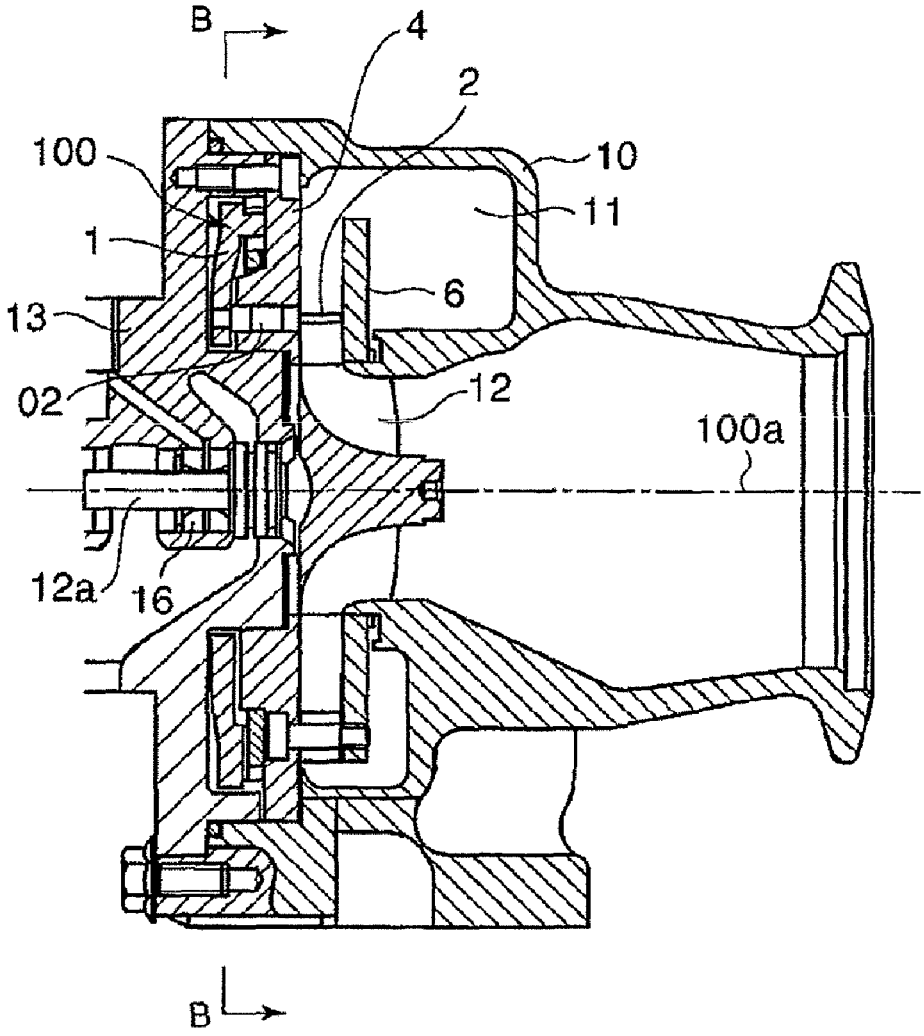
FIG. 1 is a partially sectional view showing an example of an exhaust turbocharger equipped with a variable-nozzle mechanism according to a first embodiment of the invention when taken along a rotary axis line.
Figure 2:
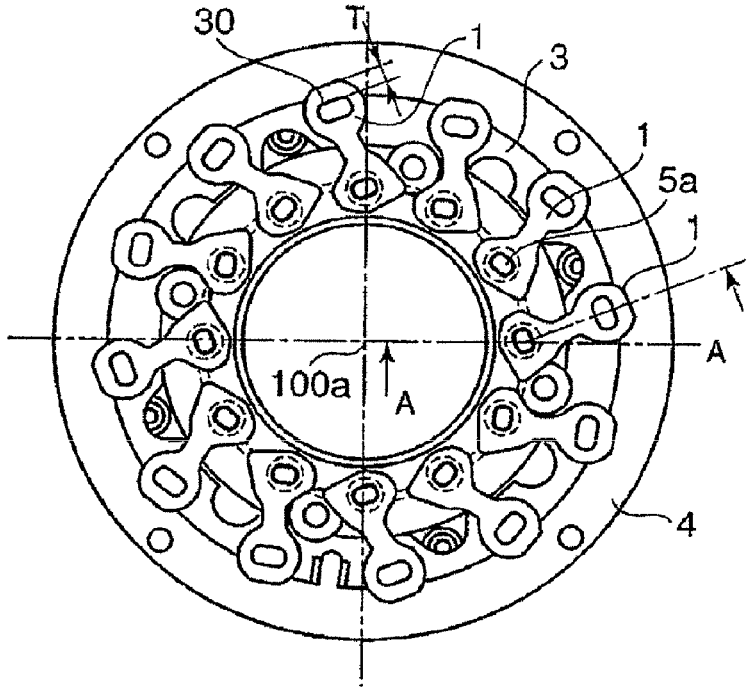
FIG. 2 is a sectional view taken along the line B-B shown in FIG. 1.
Figure 3:
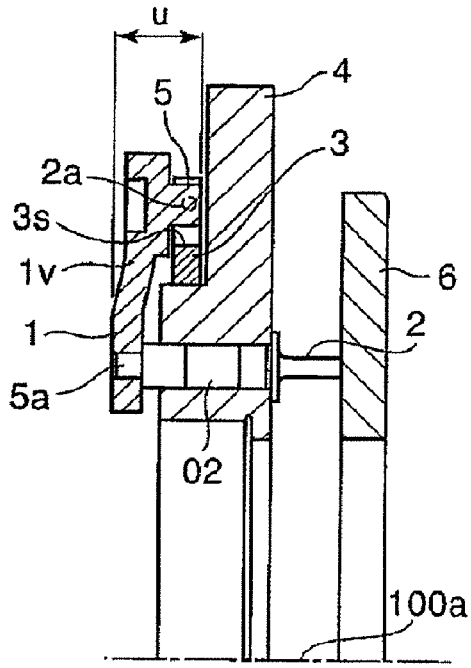
FIG. 3 is a sectional view taken along the line A-A shown in FIG. 2.

FIG. 1 is a partially sectional view showing an example of an exhaust turbocharger equipped with a variable-nozzle mechanism according to a first embodiment of the invention when taken along a rotary axis line. FIG. 2 is a sectional view taken along the line B-B shown in FIG. 1. FIG. 3 is a sectional view taken along the line A-A shown in FIG. 2.

In FIGS. 1 to 3, Reference Numeral 10 denotes a turbine casing and Reference Numeral 11 denotes a scroll having a spiral shape formed in the outer periphery of the turbine casing 10.

Reference Numeral 12 denotes a double-flow-type turbine rotor coaxially formed with a compressor (not shown), and a turbine shaft 12*a* thereof is rotatably supported to a bearing housing 13 via a bearing 16. Reference Numeral 100*a* denotes a rotary axis line of the exhaust turbocharger.

Reference Numeral 2 denotes a plurality of nozzle vanes arranged in the inner periphery of the scroll 11 in a circumferential direction at the same interval therebetween, and a nozzle shaft 02 connected to each end portion thereof is rotatably supported to a nozzle mount 4 fixed to the bearing housing 13, thereby changing a blade angle by the use of a variable-nozzle mechanism 100 described below.

The nozzle vane 2 is disposed between the nozzle mount 4 and a nozzle plate 6 formed in an annular shape and connected to the nozzle mount 4. The nozzle plate 6 is fitted to an attachment portion of the turbine casing 10.

The present invention relates to the variable-nozzle mechanism 100 for the exhaust turbocharger with the above-described configuration.

First Embodiment

Figure 7:
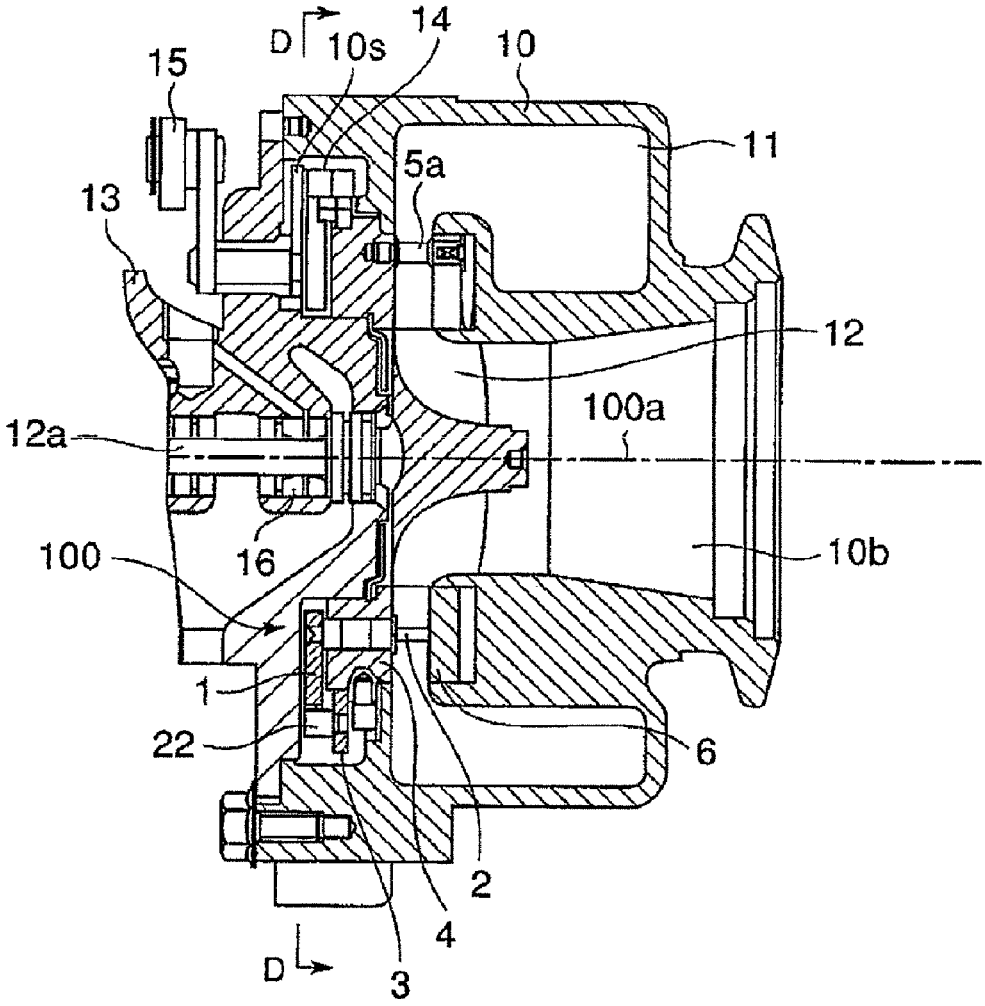
FIG. 7 is a partially sectional view showing an example of the exhaust turbocharger equipped with the variable-nozzle mechanism according to a conventional art when taken along the rotary axis line.
Figure 8:
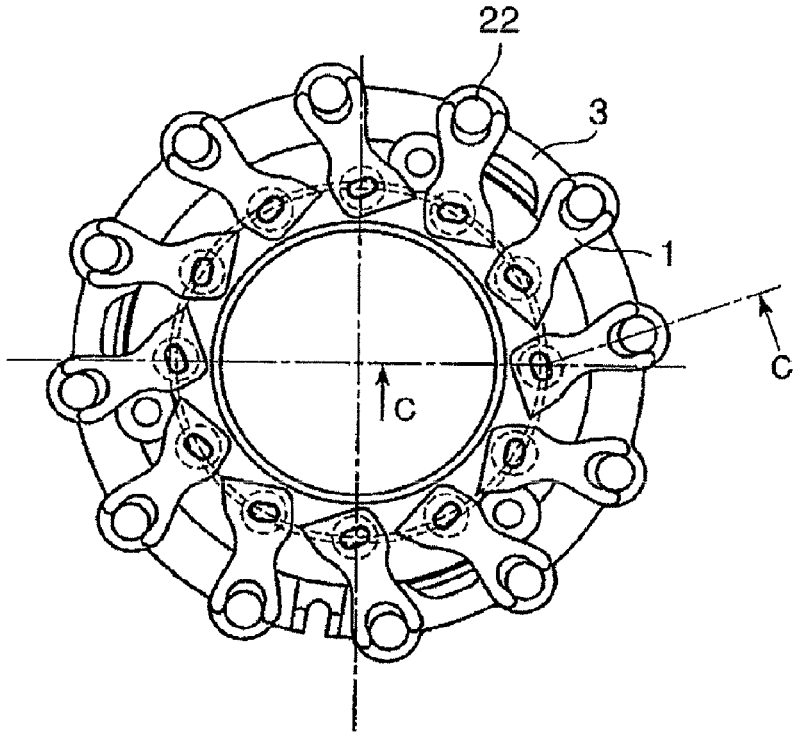
FIG. 8 is a sectional view taken along the line D-D shown in FIG. 7.
Figure 9:
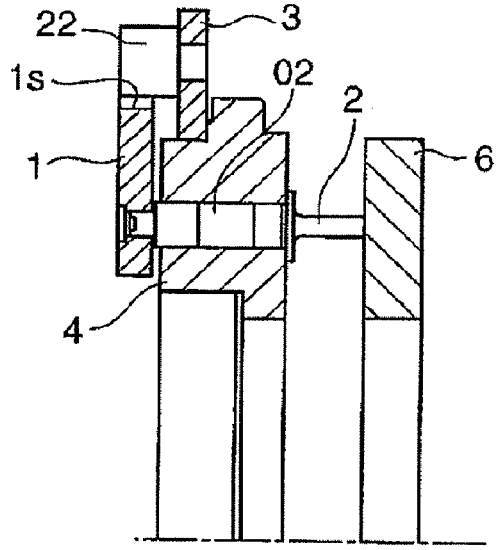
FIG. 9 is a sectional view taken along the line C-C shown in FIG. 8.
Figure 10:
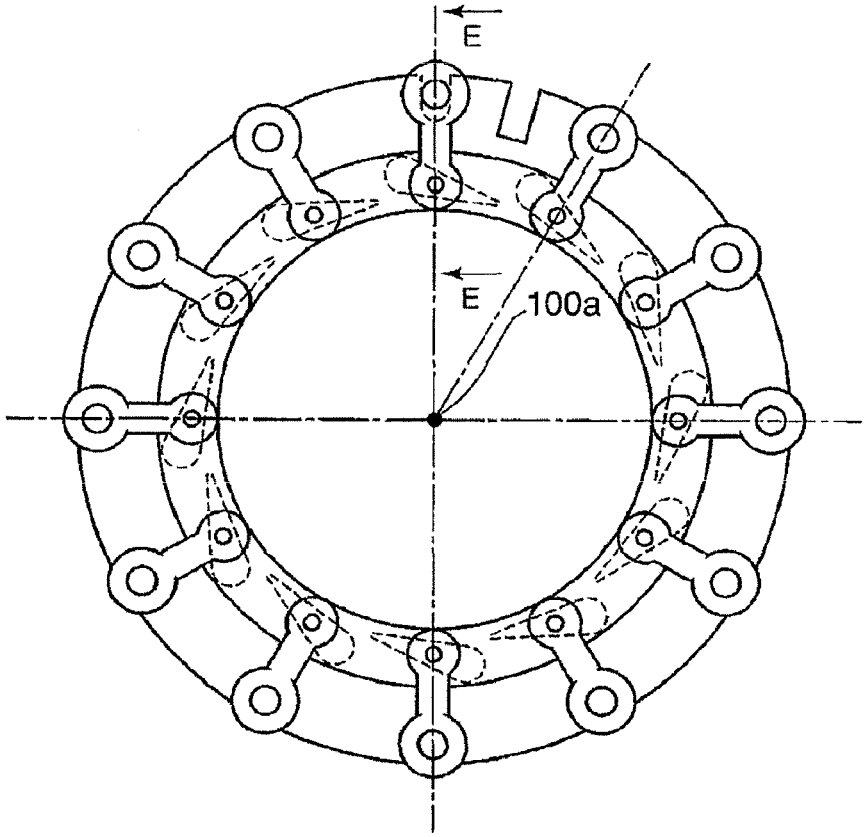
FIG. 10 is a front view showing a variable-nozzle mechanism according to a conventional art.
Figure 11:
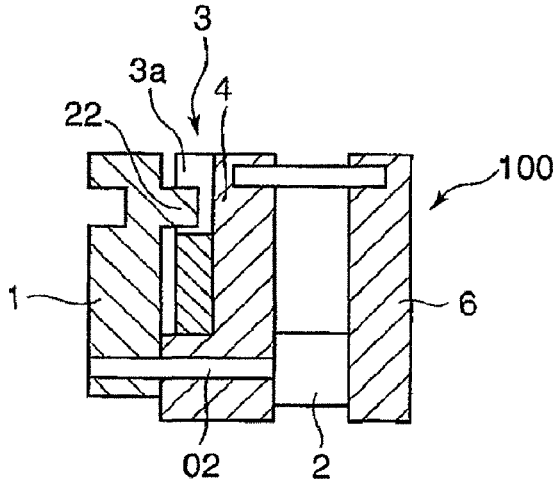
FIG. 11 is a sectional view taken along the line E-E shown in FIG. 10.

In FIGS. 1 to 3, Reference Numeral 3 denotes a drive ring formed in a disk shape and rotatably supported to the turbine casing 10. In the same manner as FIG. 7, the crank pin 10*s* engages with the drive ring 3 so as to rotationally drive the drive ring 3. Here, Reference Numeral 15 denotes a linkage connected to an actuator (not shown) as a driving source of the nozzle vane 2, and Reference Numeral 10*s* denotes a crank pin connected to the linkage 15.

Additionally, the drive ring 3 is disposed between a lever plate 1 and the nozzle mount 4 in an axial direction.

A plurality of the lever plates 1 is arranged in a circumferential direction as many as the number of the nozzle vanes 2. A curved portion 1*v* is curved in an axial direction from the surface of each lever plate 1 connected to the inner-peripheral side as a fixed portion 5*a* on the side of the nozzle vane 2. In the upper end portion of the curved portion 1*v*, an engagement protrusion 5 is integrally formed with the lever plate 1 so as to engage with a groove portion 3*s* formed in the drive ring 3 (Reference Numeral 2*a* denotes a contact point). In a caulking portion, the inner-peripheral side of the lever plate 1 is fixed to the nozzle shaft 02 of the nozzle vane 2.

Upon operating the variable-capacity exhaust turbocharger equipped with the variable-nozzle mechanism with the above-described configuration, exhaust gas discharged from an engine (not shown) flows into the scroll 11, and flows into the nozzle vane 2 while orbiting along the spiral of the scroll 11. Subsequently, the exhaust gas flows between the blades of the nozzle vane 2 and flows into the turbine rotor 12 from the outer-peripheral side. Subsequently, the exhaust gas flows toward the center in a radial direction to perform an expanding action to the turbine rotor 12 and flows in an axial direction to be guided to a gas outlet 10*b*, thereby being discharged to the outside.

Upon controlling the capacity of the variable-capacity turbine, in the actuator, a blade angle of the nozzle vane 2 is set by a blade angle control unit (not shown) so that a flow rate of the exhaust gas flowing to the nozzle vane 2 is equal to a required flow rate. A reciprocating displacement of the actuator corresponding to the blade angle is transmitted to the drive ring 3 so as to rotationally drive the drive ring 3.

In terms of the rotation of the drive ring 3, the lever plate 1 is rotated in a circumferential direction of the nozzle shaft 02 by the engagement protrusion 5 engaging with the groove portion 3*s* formed in the drive ring 3. Subsequently, in terms of the rotation of the nozzle shaft 02, the nozzle vane 2 is rotated, and the blade angle thereof is changed to the blade angle set in the actuator.

According to the first embodiment, the drive ring 3 is disposed between the lever plate 1 and the nozzle mount 4 in an axial direction. The curved portion 1*v* is curved in an axial direction from the surface of the lever plate 1 connected to the fixed portion 5*a* on the side of the nozzle vane 2. In the upper end portion of the curved part 1*v*, the engagement protrusion 5 is integrally formed with the lever plate 1 so as to engage with the groove portion 3*s* formed in the drive ring 3.

Accordingly, a ring thickness u between the fixed portion 5*a* on the side of the nozzle vane 2 and the engagement protrusion 5 in the drive ring 3 is thickened as much as the curved amount in an axial direction, thereby increasing rigidity in an axial direction and bending rigidity. Meanwhile, since the lever plate 1 is configured as a plate member curved in an axial direction, a weight of the lever plate 1 itself does not increase. Accordingly, it is possible to increase the bending rigidity without increasing the thickness of the lever plate 1.

Additionally, since the curved portion 1*v*, that is, an offset portion is formed in the lever plate 1 in an axial direction, it is possible to easily form the engagement protrusion 5 having a required thickness in the lever plate 1 configured as the thin plate. Since the engagement portion between the engagement protrusion 5 and the groove portion 3*s* of the drive ring 3 is provided close to the upper portion of the drive ring 3, bending moment at the engagement portion is reduced, thereby restricting a risk occurring when a linkage system is broken.

As shown in FIG. 2, an engagement pin portion of the engagement protrusion 5 of the lever plate 1 is formed in an oval shape 30 in which a section of a fitting-sliding surface of the engagement pin portion is formed in a circular-arc shape and a non-sliding portion of the engagement pin portion is formed in a linear shape so that a long axis of the oval shape 30 is disposed in a circumferential direction of the drive ring 3. Since the outer periphery of the engagement pin portion formed in the oval shape 30 is connected, the rigidity of the engagement pin portion is more improved than that of a U-shape engagement pin portion, and a thickness T of the engagement pin portion is smaller than that of the U-shape engagement pin portion, thereby reducing an outer diameter thereof as small as possible.

Second Embodiment

Figure 4:
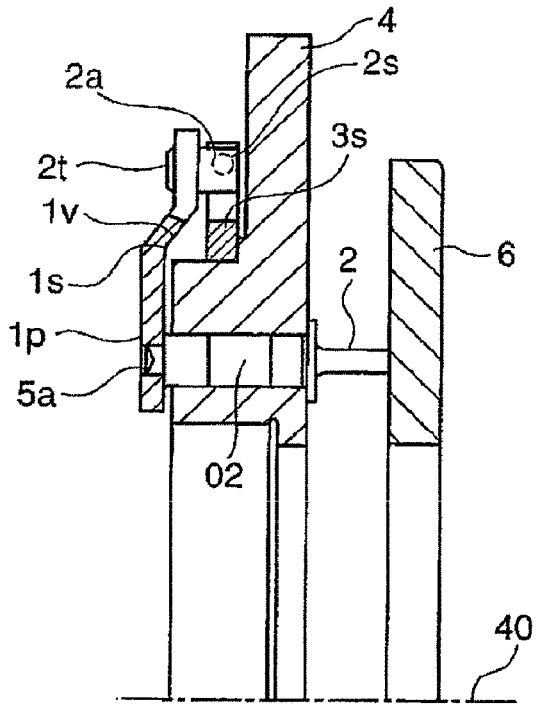
FIG. 4 is a sectional view showing a second embodiment and corresponding to FIG. 3.

FIG. 4 is a sectional view showing a second embodiment and corresponding to FIG. 3.

In the second embodiment, the engagement pin portion of the lever plate 1 is configured in such a manner that an engagement pin 2*s* is fitted in a direction perpendicular to a surface 1*p* of the lever plate 1, and the engagement pin 2*s* engages with the groove portion 3*s* of the drive ring 3 to be caulked in a caulking portion 2*t*. Reference Numeral 1*s* denotes a curved portion.

In this case, only the engagement pin 2*s* is formed of material having higher rigidity, and the lever plate 1 is configured as a low-cost member, thereby reducing a cost.

The other configurations are the same as those of the first embodiment shown in FIGS. 1 to 3, and the same reference numerals are given to the same components.

Third Embodiment

Figure 5:
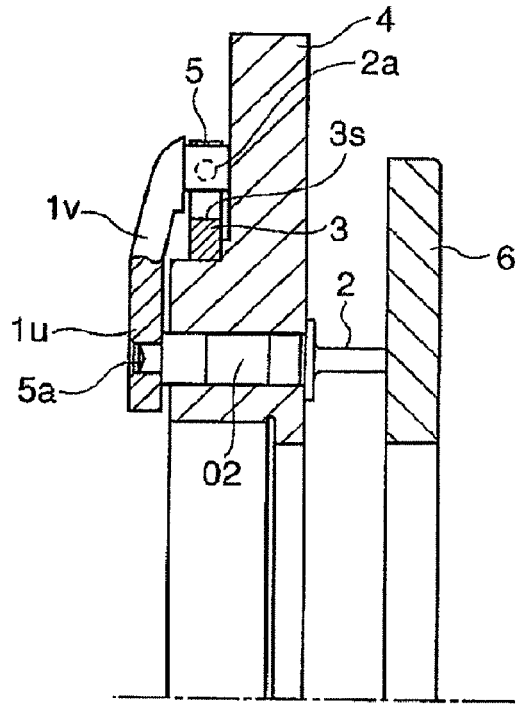
FIG. 5 is a sectional view showing a third embodiment and corresponding to FIG. 3.

FIG. 5 is a sectional view showing a third embodiment and corresponding to FIG. 3.

In the third embodiment, the drive ring 3 is disposed between the lever plate 1 and the nozzle mount 4 in an axial direction, and the lever plate 1 is connected to the fixed portion 5*a* on the side of the nozzle vane. The curved portion 1*v* curved in an axial direction from a surface 1*u* of the lever plate 1 and the engagement protrusion 5 connected to the curved portion 1*v* to engage with the groove portion 3*s* of the drive ring 3 are formed by bending one sheet of bar-shape plate.

The other configurations are the same as those of the first embodiment shown in FIGS. 1 to 3, and the same reference numerals are given to the same components.

According to the third embodiment, since the curved portion 1*v* and the engagement protrusion 5 are formed by bending one sheet of bar-shape plate, it is possible to form the engagement protrusion 5 for allowing the lever plate 1 to engage with the groove portion 3*s* of the drive ring 3. Accordingly, it is possible to manufacture the lever plate 1 at a low cost and to restrict the outer diameter of the lever plate 1.

Fourth Embodiment

Figure 6:
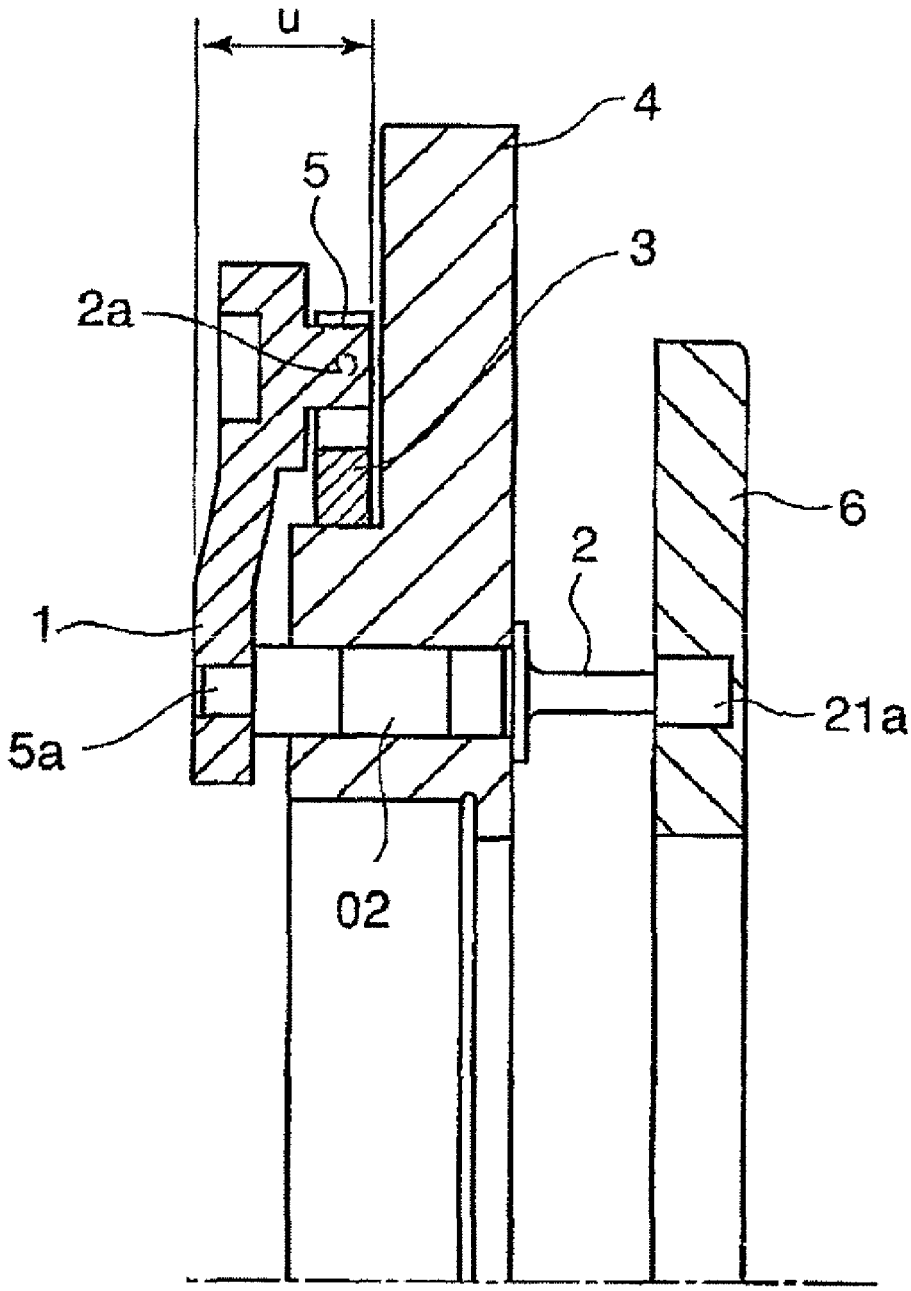
FIG. 6 is a sectional view showing a fourth embodiment and corresponding to FIG. 3.

FIG. 6 is a sectional view showing a fourth embodiment and corresponding to FIG. 3.

In the fourth embodiment, there are provided a plurality of nozzle vanes 2 of which both ends are supported in such a manner that one end is rotatably supported to the nozzle mount 4 and the other end 21*a* is supported to the nozzle plate 6.

The lever plate structure according to the first to third embodiments may be applied to the supercharger.

The other configurations are the same as those of the first embodiment shown in FIGS. 1 to 3, and the same reference numerals are given to the same components.

According to the invention, it is possible to provide the variable-capacity exhaust turbocharger equipped with the variable-nozzle mechanism having the lever plate and the peripheral structure capable of ensuring regular operability of the nozzle vane and of preventing an occurrence of local excessive stress by increasing the rigidity of the lever plate without increasing the thickness of the lever plate.

The invention claimed is:

1. A variable-capacity exhaust turbocharger equipped with a variable-nozzle mechanism comprising:

a plurality of nozzle vanes rotatably supported to a nozzle mount fixed to a bearing housing or a casing including a turbine casing;

an annular drive ring interlocked with an actuator; and a lever plate provided in a circumferential direction as many as the number of the nozzle vanes so that one end is connected to an engagement pin portion engaging with a groove portion formed in the drive ring and another end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate is curved in an axial direction from a surface of the lever plate connected to the fixed portion on the side of the nozzle vane so as to be connected to the groove portion of the drive ring.

2. The variable-capacity exhaust turbocharger equipped with the variable-nozzle mechanism according to claim 1, wherein the engagement pin portion of the lever plate is formed into an engagement protrusion integrally formed with the lever plate and engaging with the groove portion.

3. The variable-capacity exhaust turbocharger equipped with the variable-nozzle mechanism according to claim 2 wherein the engagement pin portion of the lever plate is formed in an oval shape in which a section of a fitting-sliding surface of the engagement pin portion is formed in a circular-arc shape and a non-sliding portion of the engagement pin portion is formed in a linear shape, and wherein a long axis of the oval shape is disposed in a circumferential direction of the drive ring.

4. A variable-capacity exhaust turbocharger equipped with a variable-nozzle mechanism comprising:

a plurality of nozzle vanes of which both ends are supported so that one end is rotatably supported to a nozzle mount fixed to a bearing housing or a casing including a turbine casing and the other end is supported to a nozzle plate;

an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate has a configuration according to claim 2.

5. The variable-capacity exhaust turbocharger equipped with the variable-nozzle mechanism according to claim 1, wherein the engagement pin portion of the lever plate is formed in such a manner that an engagement pin is fitted in a direction perpendicular to a surface of the lever plate and the engagement pin engages with the groove portion.

6. The variable-capacity exhaust turbocharger equipped with the variable-nozzle mechanism according to claim 5 wherein the engagement pin portion of the lever plate is formed in an oval shape in which a section of a fitting-sliding surface of the engagement pin portion is formed in a circular-arc shape and a non-sliding portion of the engagement pin portion is formed in a linear shape, and wherein a long axis of the oval shape is disposed in a circumferential direction of the drive ring.

7. A variable-capacity exhaust turbocharger equipped with a variable-nozzle mechanism comprising:

a plurality of nozzle vanes of which both ends are supported so that one end is rotatably supported to a nozzle mount fixed to a bearing housing or a casing including a turbine casing and the other end is supported to a nozzle plate;

an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate has a configuration according to claim 5.

8. The variable-capacity exhaust turbocharger equipped with the variable-nozzle mechanism according to claim 1, wherein the engagement pin portion of the lever plate is formed in an oval shape in which a section of a fitting-sliding surface of the engagement pin portion is formed in a circular-arc shape and a non-sliding portion of the engagement pin portion is formed in a linear shape, and wherein a long axis of the oval shape is disposed in a circumferential direction of the drive ring.

9. A variable-capacity exhaust turbocharger equipped with a variable-nozzle mechanism comprising:

a plurality of nozzle vanes of which both ends are supported so that one end is rotatably supported to a nozzle mount fixed to a bearing housing or a casing including a turbine casing and the other end is supported to a nozzle plate;

an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate has a configuration according to claim 1.

10. A variable-capacity exhaust turbocharger equipped with a variable-nozzle mechanism comprising:

a plurality of nozzle vanes rotatably supported to a nozzle mount fixed to a bearing housing or a casing including a turbine casing;

an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein a curved portion curved in an axial direction from a surface of the lever plate connected to the fixed portion on the side of the nozzle vane and an engagement protrusion connected to the curved portion and engaging with the groove portion are formed by bending one sheet of plate.

11. The variable-capacity exhaust turbocharger equipped with the variable-nozzle mechanism according to claim 10 wherein the engagement pin portion of the lever plate is formed in an oval shape in which a section of a fitting-sliding surface of the engagement pin portion is formed in a circular-arc shape and a non-sliding portion of the engagement pin portion is formed in a linear shape, and wherein a long axis of the oval shape is disposed in a circumferential direction of the drive ring.

12. A variable-capacity exhaust turbocharger equipped with a variable-nozzle mechanism comprising:

a plurality of nozzle vanes of which both ends are supported so that one end is rotatably supported to a nozzle mount fixed to a bearing housing or a casing including a turbine casing and the other end is supported to a nozzle plate;

an annular drive ring interlocked with an actuator; and a lever plate provided in a circumferential direction as many as the number of the nozzle vanes so that one end is connected to an engagement pin portion engaging with a groove portion formed in the drive ring and the other end is fixed to each nozzle vane, wherein each lever plate is swung by a rotation of the drive ring, and each blade angle of the plurality of nozzle vanes is changed by the swing of the lever plate, wherein the drive ring is disposed between the lever plate and the nozzle mount in an axial direction, and wherein the lever plate has a configuration according to claim 10.

* * * * *